US007719244B2

(12) United States Patent
Heilmann

(10) Patent No.: US 7,719,244 B2
(45) Date of Patent: May 18, 2010

(54) METHOD AND APPARATUS FOR ENABLING A VOLTAGE REGULATOR

(75) Inventor: Benjamin Heilmann, Raleigh, NC (US)

(73) Assignee: Qimonda North America Corp., Cary, NC (US)

( * ) Notice: Subject to any disclaimer, the term of this patent is extended or adjusted under 35 U.S.C. 154(b) by 257 days.

(21) Appl. No.: 11/778,805

(22) Filed: Jul. 17, 2007

(65) Prior Publication Data

US 2009/0021229 A1 Jan. 22, 2009

(51) Int. Cl.
*G05F 1/40* (2006.01)

(52) U.S. Cl. ..... 323/282

(58) Field of Classification Search ..... 323/268, 323/271, 282, 285, 288, 351, 901
See application file for complete search history.

(56) References Cited

U.S. PATENT DOCUMENTS 4,176,308 A 11/1979 Dobkin et al.
5,180,988 A * 1/1993 McDaniel ..... 330/282
5,329,246 A * 7/1994 Mahabadi ..... 330/267
5,345,422 A 9/1994 Redwine
5,686,824 A 11/1997 Rapp
6,188,210 B1 2/2001 Tichauer et al.
7,034,569 B1 4/2006 Balasubramanian et al.
7,116,088 B2 10/2006 Tran et al.
7,253,596 B2 * 8/2007 Yamamoto et al. ..... 323/281
2003/0206422 A1 11/2003 Gucyski
2003/0218454 A1 11/2003 Cunnac et al.
2004/0245975 A1 12/2004 Tran et al.
2006/0071703 A1 4/2006 Chatterjee et al.
2006/0104001 A1 5/2006 Yoshio
2007/0001657 A1 1/2007 Mellachurvu et al.

* cited by examiner

*Primary Examiner*—Matthew V Nguyen
(74) *Attorney, Agent, or Firm*—Coats & Bennett, P.L.L.C.

(57) ABSTRACT

A voltage regulator circuit is operated by enabling a bias network operable to set a bias current in an amplifier. A startup circuit is connected to the bias network, the startup circuit operable to assist the bias network in setting the amplifier bias current during a startup period. The startup circuit is disconnected from the bias network responsive to the startup period lapsing while the voltage regulator circuit is enabled for resetting the startup circuit to an initial state. The bias network may be disabled to reduce the amplifier bias current. Subsequent re-enablement of the bias network is prevented until the amplifier is reliably disabled.

15 Claims, 7 Drawing Sheets

METHOD AND APPARATUS FOR ENABLING A VOLTAGE REGULATOR

BACKGROUND OF THE INVENTION

High performance voltage regulators are typically used in applications having large and fast-changing current load conditions such as when a memory device or processor operates in an active mode. High performance voltage regulators conventionally include an amplifier for generating a regulated voltage output in response to a reference voltage and a feedback voltage. Also included are a power transistor and bias network. The power transistor boosts the amplifier output while the bias network provides bias voltages to the amplifier for setting the internal bias currents of the amplifier. A high amplifier bias current allows quick regulation of the power transistor gate voltage, thus increasing regulator performance.

High performance voltage regulators are at least partially disabled when load currents are low and steady to reduce power consumption, e.g., during low power or standby mode. Power consumption is reduced when a voltage regulator is disabled because amplifier bias current is significantly reduced. One conventional approach for disabling a voltage regulator is to set the gate-to-source voltage of the power transistor to zero volts, thus turning off the power transistor. A switch may also prevent current flow through the bleeder resistor coupled to the power transistor. The regulator amplifier is also disabled by disconnecting the main bias voltage applied to the bias network, thus disabling the bias network. Each output node of the bias network is driven to an appropriate voltage level when the bias network is disabled, ensuring that the amplifier is properly disabled. This way, the bias voltages applied to amplifier do not float to problematic levels when the regulator is disabled.

When the voltage regulator is subsequently re-enabled, the bias network charges the internal capacitance of the amplifier from a disabled state to a desired level before the amplifier can generate a properly regulated output. Some conventional voltage regulator circuits include a startup circuit, such as boost capacitors, for assisting the bias network in setting the amplifier bias current when the regulator is being re-enabled. Conventional startup circuits are reset to an initial state when the voltage regulator is disabled. This way, the startup circuit is ready to assist the bias network when enabled, as long as the startup circuit was properly re-initialized while the voltage regulator was disabled.

However, voltage regulators can be disabled and then quickly re-enabled. If the regulator is re-enabled too quickly, conventional startup circuits may not have enough time to properly re-initialize while the voltage regulator is disabled. An improperly reset startup circuit may charge/discharge the amplifier bias voltages to problematic voltage levels, thus causing the amplifier to operate improperly. Improper amplifier operation may degrade circuit performance, cause circuit malfunction, and decrease yields. Further, conventional regulator amplifiers may not be properly disabled when regulator re-enablement occurs too quickly. For example, the amplifier bias voltages may not have enough time to fully charge/discharge to the appropriate level before the regulator is re-enabled. An improperly disabled amplifier may also cause performance degradation, malfunction, and decrease yields.

SUMMARY OF THE INVENTION

According to the methods and apparatus taught herein, a voltage regulator circuit is operated by enabling a bias network operable to set a bias current in an amplifier. A startup circuit is connected to the bias network, the startup circuit operable to assist the bias network in setting the amplifier bias current during a startup period. The startup circuit is disconnected from the bias network responsive to the startup period lapsing while the voltage regulator circuit is enabled for resetting the startup circuit to an initial state. The bias network may be disabled to reduce the amplifier bias current. Subsequent re-enablement of the bias network is prevented until the amplifier is reliably disabled.

Of course, the present invention is not limited to the above features and advantages. Those skilled in the art will recognize additional features and advantages upon reading the following detailed description, and upon viewing the accompanying drawings.

DETAILED DESCRIPTION OF THE INVENTION

Figure 1:
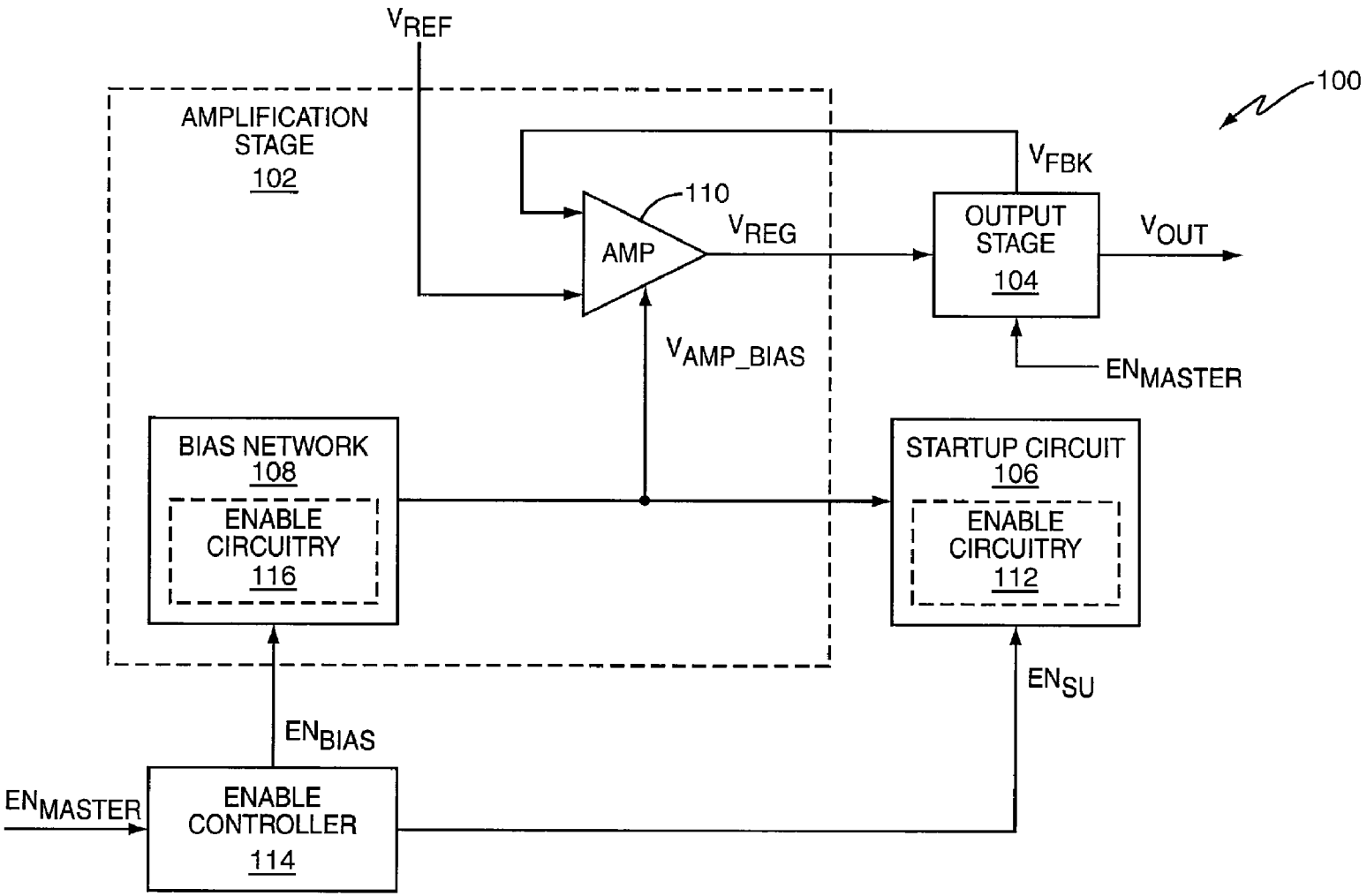
FIG. 1 is a block diagram of an embodiment of a voltage regulator circuit.

FIG. 1 illustrates an embodiment of a voltage regulator circuit 100 having an amplification stage 102, output stage 104 and a startup circuit 106. The amplification stage 102 includes a bias network 108 and an amplifier 110. The amplifier 110 outputs a regulated voltage ($V_{REG}$) in response to a reference voltage input ($V_{REF}$) and a feedback voltage ($V_{FBK}$) received from the output stage 104. The bias network 108 provides one or more bias voltages ($V_{AMP_BIAS}$) to the amplifier 110 for setting a bias current in the amplifier 110. When the voltage regulator 100 is disabled, each amplifier bias voltage is charged/discharged to a desired voltage level that ensures the amplifier 110 is placed in a non-problematic disabled state. The voltage regulator 100 may be re-enabled after the amplifier 110 has been properly disabled.

When the voltage regulator 100 is re-enabled, the startup circuit 106 assists the bias network 108 in setting the amplifier bias current during an initial startup period. In one embodiment, the startup circuit 106 helps charge/discharge the amplifier bias voltages from their disabled levels. The startup circuit 106 includes enable circuitry 112 for disconnecting the startup circuit 106 from the bias network 108 after the startup period lapses. The startup circuit 106 resets to an initial state when disconnected from the bias network 108. This way, the startup circuit 106 is re-initialized before the regulator 100 is disabled and is thus ready to assist the bias network 108 whenever the regulator 100 is re-enabled, even if the regulator 100 is re-enabled quickly.

An enable controller 114 included in or associated with the voltage regulator 100 controls whether the startup circuit 106 is enabled or disabled. The enable controller 114 generates a first enable signal ($EN_{SU}$) based on a master enable signal ($EN_{MASTER}$) that indicates the operating state of the voltage regulator 100. The first enable signal is activated when the voltage regulator 100 is to be enabled. In response, the startup circuit enable circuitry 112 connects the startup circuit 106 to the bias network 108 so that the startup circuit 106 may assist the bias network 108 in setting the amplifier bias current. Thus, both the bias network 108 and startup circuit 106 set the amplifier bias current during an initial regulator startup period. When the startup period expires, the first enable signal is deactivated, causing the startup enable circuitry 112 to disconnect the startup circuit 106 from the bias network 108. This allows the startup circuit 106 to reset to an initial state while the regulator 100 is still enabled without disrupting amplifier 110 operation.

Figure 2:
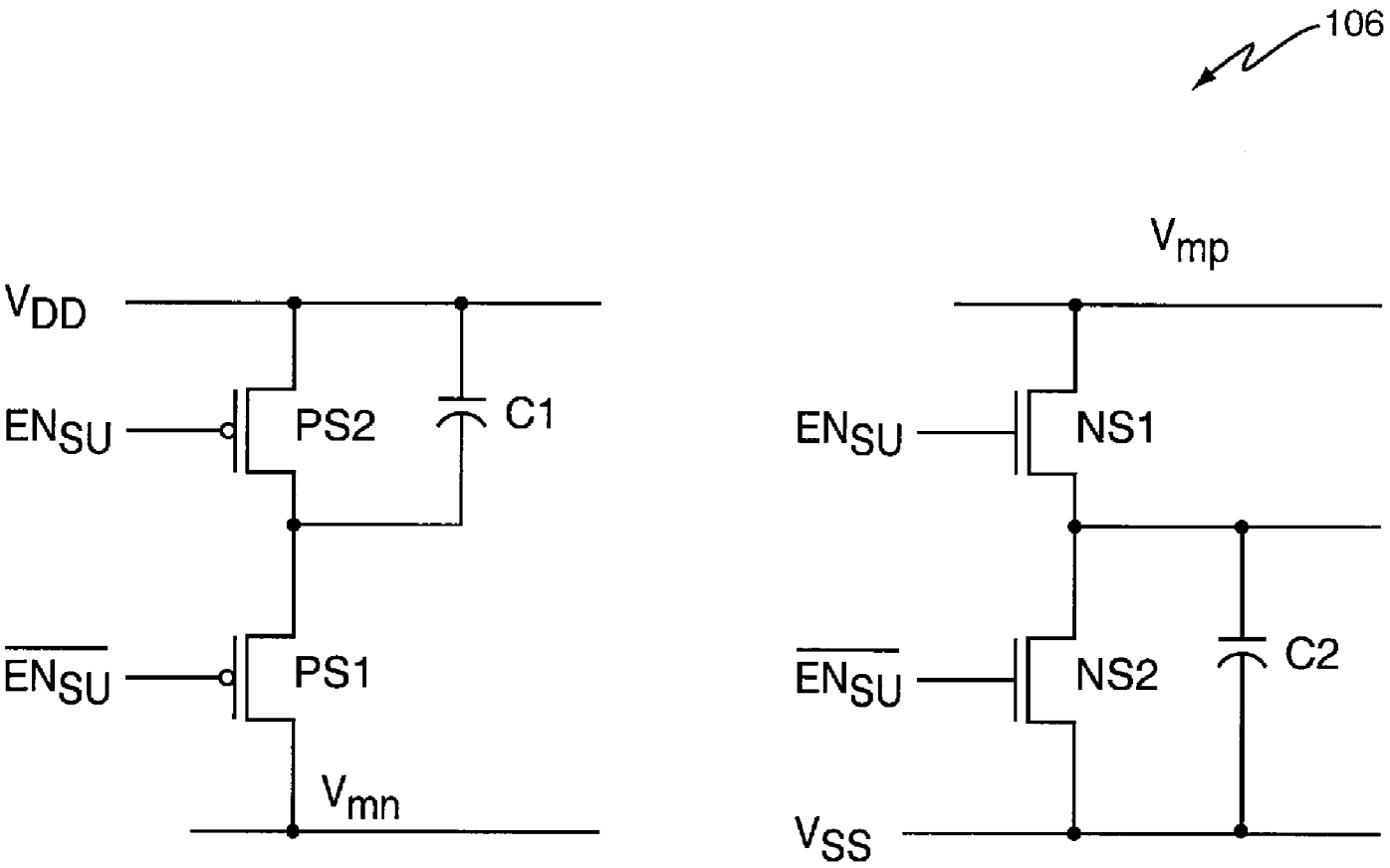
FIG. 2 is a block diagram of an embodiment of a voltage regulator startup circuit and corresponding enable circuitry.

FIG. 2 illustrates one embodiment of the startup circuit 106 and corresponding enable circuitry 112. According to this embodiment, the startup circuit 106 comprises boost capacitors C1 and C2. However, any suitable startup circuit may be employed. With this understanding, boost capacitor C1 assists the bias network 108 in charging amplifier bias voltage node $V_{mn}$ during a regulator re-enablement startup period. Bias voltage node $V_{mn}$ is one of the bias network output nodes coupled to the amplifier 110. Boost capacitor C2 similarly assists the bias network 108 in discharging amplifier bias voltage node $V_{pn}$ during the startup period. Bias voltage node $V_{pn}$ is another bias network output node coupled to the amplifier 110. According to this embodiment, bias voltage node $V_{mn}$ biases n-fet transistors included in the amplifier 110 while bias voltage node $V_{pn}$ biases corresponding p-fet transistors. The number of bias voltages applied to the amplifier 110 depends on the amplifier architecture. For example, in another embodiment, the amplifier 110 has a folded cascode architecture. Accordingly, the startup circuit 106 may assist the bias network 108 in charging/discharging a third bias voltage node (not shown) coupled to one or more cascode transistors included in the amplifier 110.

Regardless, the startup enable signal ($EN_{SU}$) is activated when the voltage regulator 100 is re-enabled from a disabled state. In response, a first p-fet transistor PS1 couples boost capacitor C1 to amplifier bias voltage node $V_{mn}$. Boost capacitor C1 quickly pulls the bias voltage node $V_{mn}$ toward the boost capacitor supply voltage $V_{DD}$. The boost capacitor voltage and bias voltage node $V_{mn}$ eventually reach a desired equilibrium point. A first n-fet transistor NS1 similarly couples boost capacitor C2 to amplifier bias voltage node $V_{mp}$. Boost capacitor C2 quickly pulls the bias voltage node $V_{mp}$ toward the boost capacitor supply voltage $V_{SS}$. The boost capacitor voltage and bias voltage node $V_{mp}$ also reach a desired equilibrium point. The boost capacitance may be chosen so that the initial movement of the respective bias voltages is at or close to the desired equilibrium level during the regulator startup period, the equilibrium level corresponding to the ratio of boost capacitance to the internal amplifier capacitance along with the voltage difference between the two.

The startup enable signal is deactivated when the startup period lapses. In response, first p-fet transistor PS1 switches off and a second p-fet transistor PS2 switches on to disconnect boost capacitor C1 from the amplifier bias voltage node $V_{mn}$ and bring the voltage across boost capacitor C1 to 0V. Similarly, first n-fet transistor NS1 switches off and a second n-fet transistor NS2 disconnects boost capacitor C2 from the amplifier bias voltage node $V_{mp}$ and bring the voltage across boost capacitor C2 to 0V. This way, the startup circuit 106 may reset while the regulator 100 is still enabled.

To this end, second p-fet transistor PS2 shorts both terminals of boost capacitor C1 to $V_{DD}$ when PS2 is on and PS1 is off. Accordingly, boost capacitor C1 charges to $V_{DD}$ when the startup circuit 106 is disconnected from the bias network 108. In a similar manner, second n-fet transistor NS2 shorts both terminals of boost capacitor C2 to $V_{SS}$, discharging boost capacitor C2 to $V_{SS}$. This way, the startup circuit 106 is reset to an initial state in response to the enable controller 114 deactivating the startup circuit enable signal in response to the initial startup period ending.

The enable controller 114 may also control whether the bias network 108 is enabled or disabled. The enable controller 114 generates a second enable signal ($EN_{BIAS}$) based on the master enable signal. The second enable signal prevents re-enablement of the bias network 108 until the amplifier 110 has been reliably disabled. In one embodiment, the bias network enable signal is not activated until the bias voltage nodes coupled to the amplifier 110 attain a suitable level for placing the amplifier 110 in a known disabled state. When the bias network enable signal is activated, enable circuitry 116 included in or associated with the bias network 108 allows the bias network 108 to charge/discharge the amplifier bias voltages to their proper operating levels.

Figure 3:
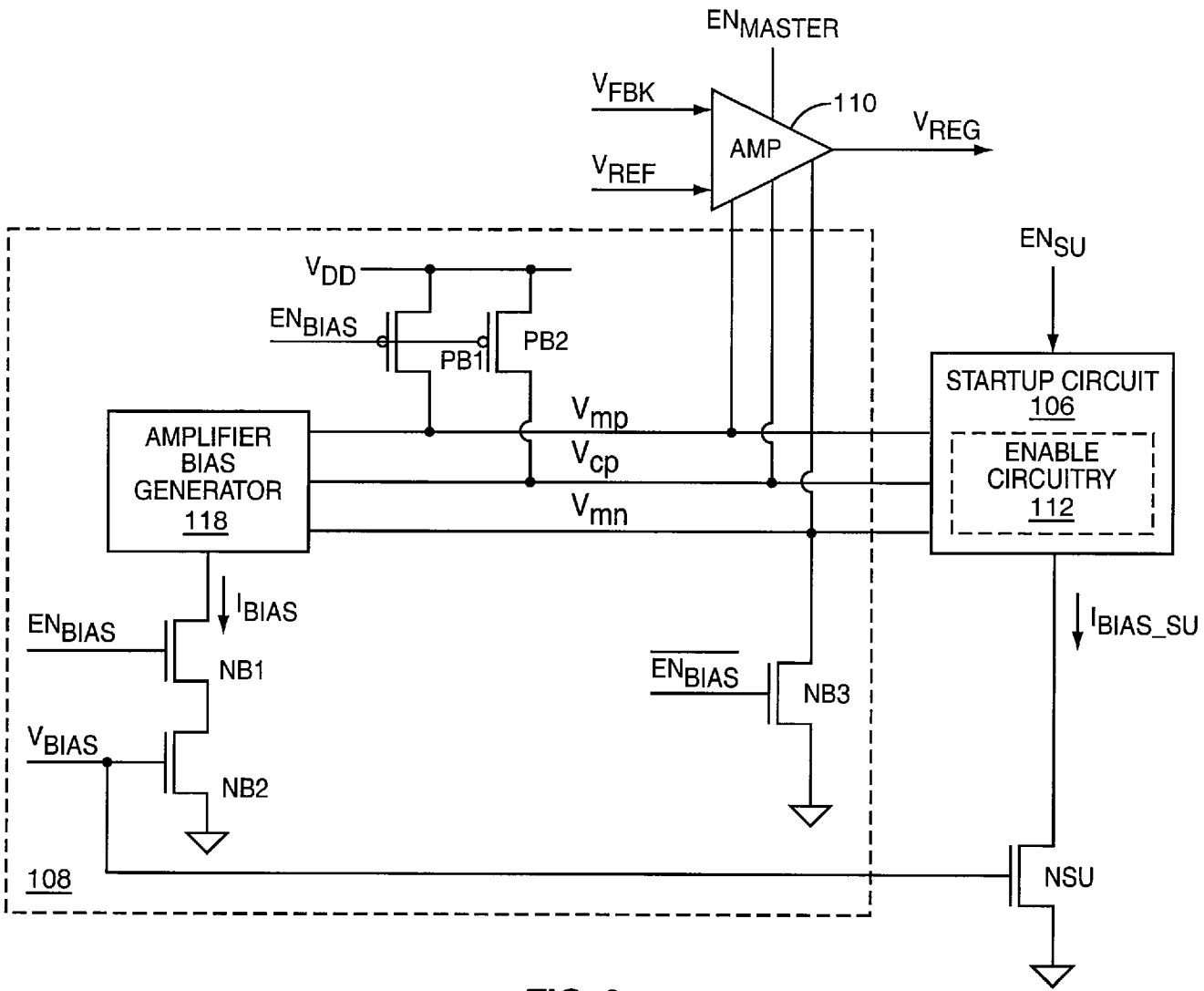
FIG. 3 is a block diagram of an embodiment of a voltage regulator bias network and corresponding enable circuitry.

FIG. 3 illustrates an embodiment of the bias network 108 and corresponding enable circuitry 116. In one embodiment, the amplifier 110 has a folded cascode architecture. As such, three bias voltages are generated by an amplifier bias generator 118 in response to the bias voltage input ($V_{BIAS}$). A first bias voltage ($V_{mp}$) is applied to p-fet transistors (not shown) included in the amplifier 110. A second bias voltage ($V_{cp}$) is applied to cascode p-fet transistors (not shown) included in the amplifier 110. The third bias voltage ($V_{mn}$) is applied to corresponding n-fet transistors (not shown). The three bias voltages set the amplifier bias current as is well know in the art. However, any number of bias voltages may be generated by the bias network 108. In general, the number of bias voltages applied to the amplifier 110 depends on the amplifier architecture. Since any suitable amplifier architecture may be employed, any corresponding number of bias voltages is within the scope of the embodiments disclosed herein.

Regardless, the bias voltages applied to the amplifier 110 maintain the amplifier bias current within a desired range when the bias network 108 is enabled. According to the embodiment illustrated in FIG. 3, a first n-fet transistor NB1 allows a second n-fet transistor NB2 to generate a bias current ($I_{BIAS}$) for the bias generator 118 when the bias network enable signal ($EN_{BIAS}$) is activated. The bias voltages $V_{mp}$, $V_{cp}$, and $V_{mn}$ output by the bias generator 118 correspond to the bias current generated by n-fet NB2. The bias voltages are applied to the amplifier 110 to set the amplifier bias current when the regulator 100 is enabled. The startup circuit 106 may initially assist the bias network 108 in charging/discharging the bias voltage nodes so that the amplifier 110 may be quickly enabled. Some types of startup circuits may require a bias current to operate properly. For these types of startup circuits, an n-fet transistor NSU provides the bias current ($I_{BIAS_SU}$) to the startup circuit 106 in response to $V_{BIAS}$. Either way, the startup circuit 106 assists the bias network 108 in quickly enabling the amplifier 110 when the regulator 100 is first re-enabled.

The enable controller 114 deactivates the bias network enable signal when the voltage regulator 100 is to be disabled. In response, n-fet transistor NB1 prevents current flow in the bias generator 118. Further, p-fet transistors PB1 and PB2 pull the p-fet bias voltage nodes $V_{mp}$ and $V_{cp}$ to $V_{DD}$ so that p-fet transistors included in the amplifier 110 have a gate-to-source voltage of approximately zero volts. Similarly, an n-fet transistor NB3 pulls the n-fet bias voltage node $V_{mn}$ to $V_{SS}$ so that n-fet transistors included in the amplifier 110 also have a gate-to-source voltage of approximately zero volts. This way, the transistors included in the amplifier 110 are disabled when the bias network enable signal is deactivated.

The bias network 108 may be re-enabled after the amplifier 110 has been reliably disabled. According to the embodiment illustrated in FIG. 3, the amplifier 110 is reliably disabled when the bias voltage nodes are charged/discharged to voltage levels sufficient for placing the amplifier 110 in a known disabled state. This occurs when $V_{mp}$ is charged to $V_{DD}$ by p-fet transistor PB1, $V_{cp}$ is charged to $V_{DD}$ by p-fet transistor PB2, and $V_{mn}$ is charged to $V_{SS}$ by n-fet transistor NB3. The enable controller 114 may re-activate the bias network enable signal after the bias voltage nodes have been properly charged/discharged.

Figure 4:
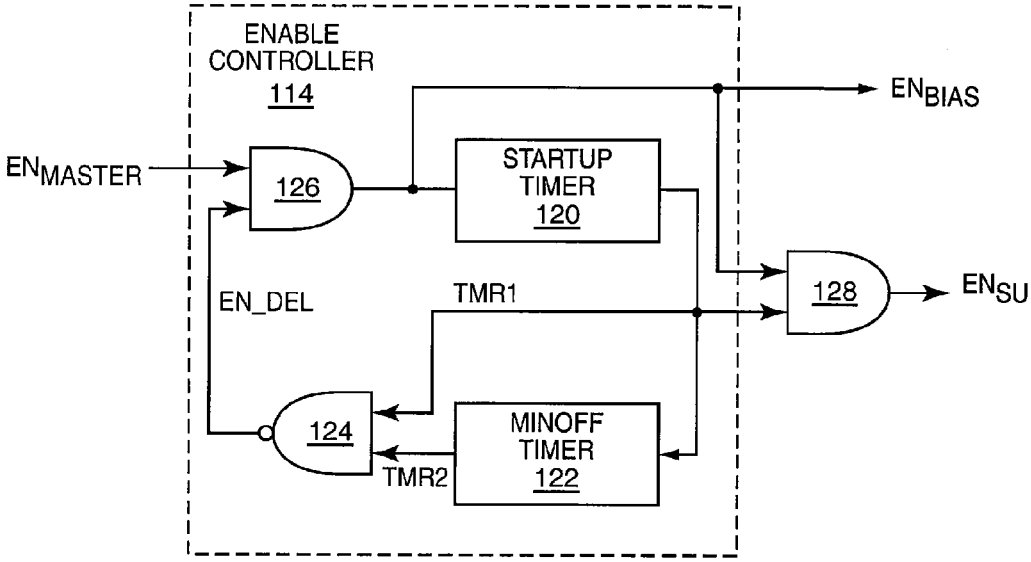
FIG. 4 is a block diagram of an embodiment of a voltage regulator enable controller.

FIG. 4 illustrates one embodiment of the enable controller 114. According to this embodiment, the enable controller 114 generates both the bias network enable signal ($EN_{BIAS}$) and the startup circuit enable signal ($EN_{SU}$) based on the master enable signal ($EN_{MASTER}$). The startup circuit enable signal is activated when the regulator 100 is first enabled. The startup circuit 106 assists the bias network 108 in re-enabling the amplifier 110 until an initial regulator startup period ends. The enable controller 114 then deactivates $EN_{SU}$. In response, the startup circuit 106 is disconnected from the bias network 108 and resets as previously described. The master enable signal is activated each time the voltage regulator 100 is to be re-enabled. In response, the enable controller 114 reactivates the bias network enable signal after the amplifier 110 has been reliably disabled as previously described herein. This way, circuit behavior is not adversely impacted by an improperly disabled amplifier.

Figure 5:
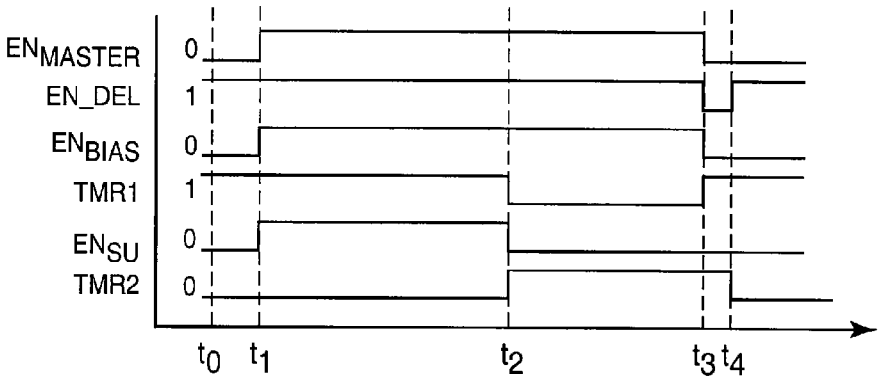
FIG. 5 is a timing diagram illustrating operation of the voltage regulator enable controller of FIG. 4.

Operation of the enable controller embodiment of FIG. 4 is described next with reference to the timing diagram illustrated in FIG. 5. The enable controller 114 includes a startup timer 120 and a minoff timer 122. The timers 120, 122 invert and delay on the rising edge of their respective inputs and simply invert on the falling edge of the inputs, and thus are rising-edge triggered. The startup timer output (TMR1) is initially set to a logic one. The startup timer 120 is triggered when the master enable signal is activated. The startup timer output remains at a logic one level until time t2, at which point it transitions to a logic zero. The startup timer output is reset set to a logic one when the master enable signal transitions to a logic low level at time t3. The minoff timer output (TMR2) is initially set to a logic zero and transitions to a logic one at time t2 when TMR1 goes low. The minoff timer 122 is triggered when the startup timer output transitions to a logic one at time t3. In response, the minoff timer output has a delayed transition back to a logic zero level at time t4, the difference between times t3 and t4 corresponding to the delay of the minoff timer 122.

The output (EN_DEL) of a NAND logic gate 124 remains at a logic one level unless the timer outputs TMR1 and TMR2 are both a logic one. This occurs between times t3 and t4. In turn, an AND logic gate 126 ensures that the bias network enable signal ($EN_{BIAS}$) is activated when the master enable signal is activated except when both timer outputs are at a logic one level. Thus, the bias network enable signal activates at time t1 and remains active until time t3, the point at which both timer outputs transition to at a logic one level. This ensures that the bias network enable signal is not re-activated at least until time t4 even if the master enable signal reactivates between times t3 and t4. The time difference between t3 and t4 represents the amount of time required by the amplifier 110 to reliably shutdown. As such, the internal delay of the minoff timer 122 may be selected to ensure that the bias network enable signal remains deactivated until the amplifier 110 is reliably disabled even if the master enable signal is reactivated before this occurs, but is preferably short enough so that regulator operation is not adversely affected.

The output of a second AND logic gate 128 determines the activation state of the startup circuit enable signal ($EN_{SU}$). The output of the second AND logic gate 128 depends on the state of the bias network enable signal and the startup timer output. Thus, the startup circuit enable signal is active from time t1 to time t2. At time t2, the startup circuit enable signal is deactivated. The internal delay of the startup timer 120 may be selected to ensure that the startup circuit 106 is enabled long enough to satisfactorily assist the bias network 108 in powering up the amplifier 110. The enable controller embodiment of FIG. 4 controls enablement of both the bias network 108 and the startup circuit 106. In another embodiment, the enable controller 114 may only control one of the bias network 108 or the startup circuit 106, but not both.

Figure 6:
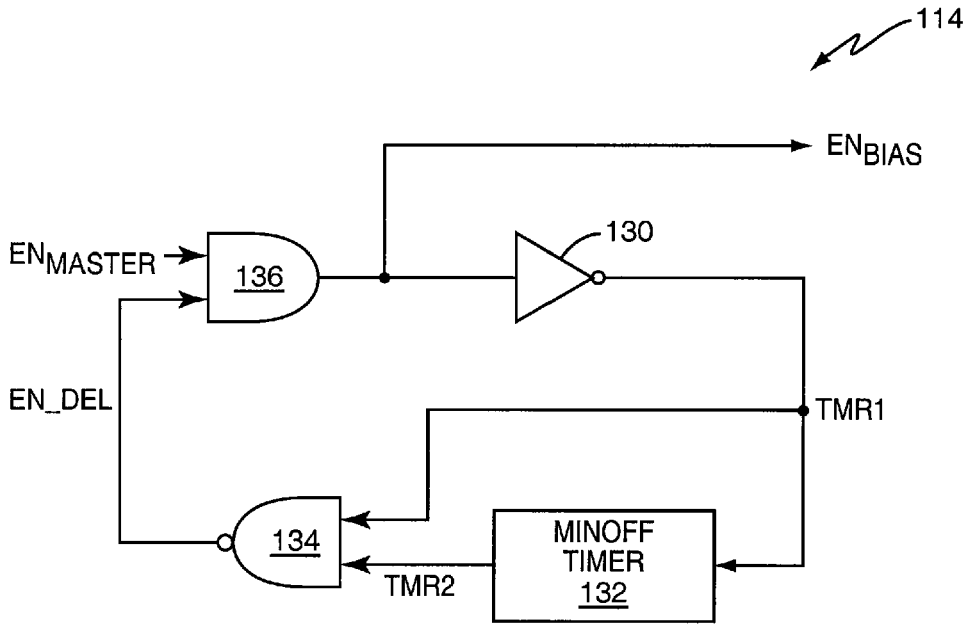
FIG. 6 is a block diagram of another embodiment of a voltage regulator enable controller.

FIG. 6 illustrates another embodiment of the enable controller 114 where only the bias network 108 is controlled by the enable controller 114. Enablement of the startup circuit 106, if present, may be directly controlled by the master enable signal according to this embodiment. Operation of the enable controller embodiment of FIG. 6 is described next with reference to the timing diagram illustrated in FIG. 7. The enable controller 114 of FIG. 6 is similar to the one illustrated in FIG. 4, except it does not include the startup timer 120 and the second AND logic gate 128 for generating a startup circuit enable signal. The bias network enable signal ($EN_{BIAS}$) is generated in a manner similar to that shown in FIGS. 4 and 5.

Particularly, the output (TMR1) of an inverter 130 is initially set to a logic one at time t0 when the master enable signal ($EN_{MASTER}$) is deactivated. The inverter output transitions to a logic zero at time t1 when the master enable signal activates. The inverter output is reset to a logic one when the master enable signal subsequently transitions to a logic low level at time t2. The output (TMR2) of a minoff timer 132 is initially set to a logic zero at time t0. The minoff timer output transitions to a logic one level at time t1 in response to the inverter output changing to a logic zero at time t1. The minoff timer output remains at the logic one level until the minoff timer 132 is triggered by the rising-edge transition of the inverter output at time t2. The minoff timer output has a delayed transition back to a logic zero level at time t3 in response to the inverter output triggering the minoff timer 132 at time t2. The difference between times t2 and t3 corresponds to the delay of the minoff timer 132.

Figure 7:
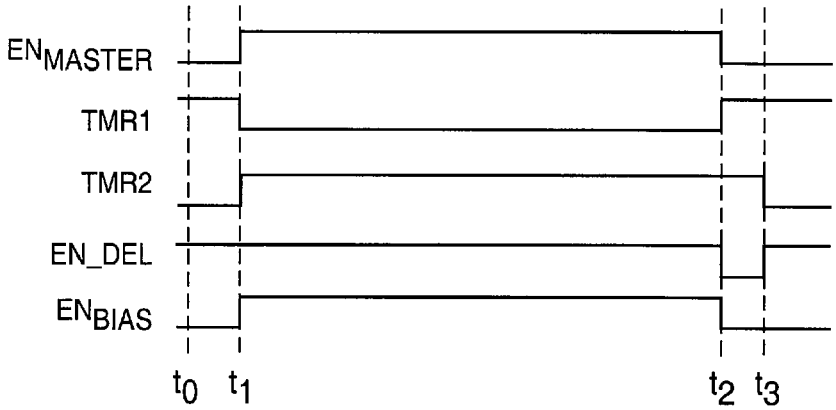
FIG. 7 is a timing diagram illustrating operation of the voltage regulator enable controller of FIG. 6.

The output (EN_DEL) of a NAND logic gate 134 remains at a logic one level unless the inverter output TMR1 and the minoff timer output TMR2 are both a logic one, which occurs between times t2 and t3 in FIG. 7. An AND logic gate 136 ensures that the bias network enable signal ($EN_{BIAS}$) is activated when the master enable signal ($EN_{MASTER}$) is activated except when both the inverter and timer output are at a logic one level. This ensures that the bias network enable signal is not re-activated until the earliest time t3 even if the master enable signal reactivates between times t2 and t3.

Figure 8:
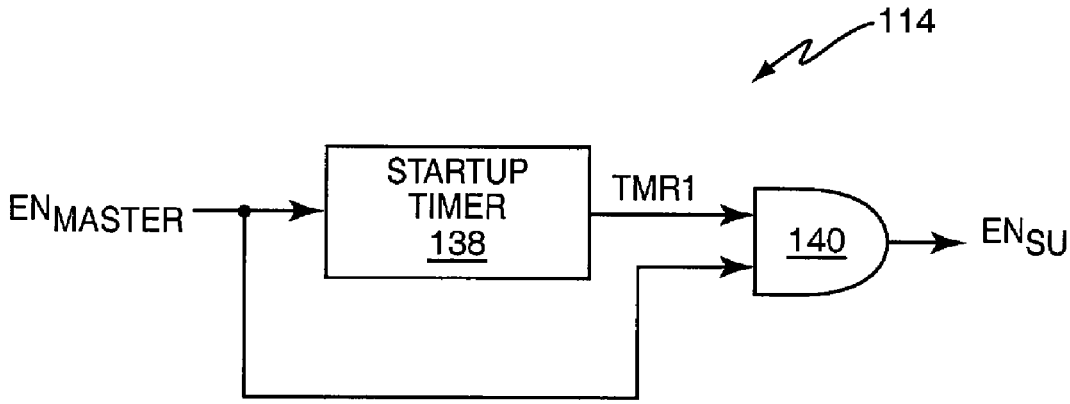
FIG. 8 is a block diagram of an yet another embodiment of a voltage regulator enable controller.
Figure 9:
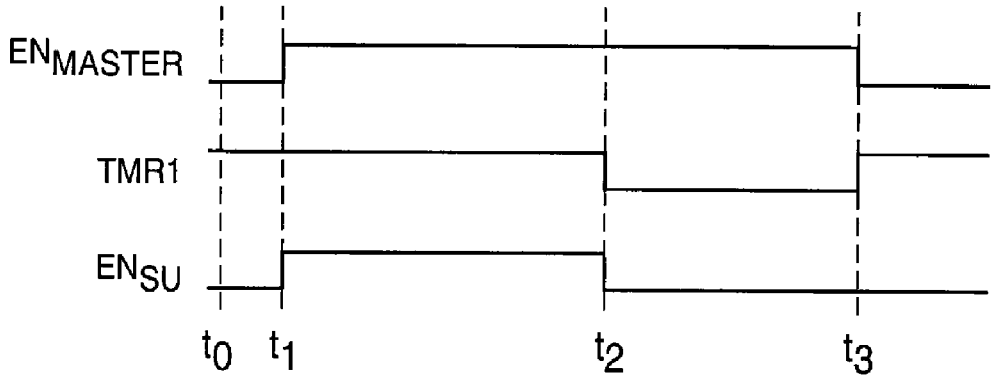
FIG. 9 is a timing diagram illustrating operation of the voltage regulator enable controller of FIG. 8.

FIG. 8 illustrates yet another embodiment of the enable controller 114 where only operation of the startup circuit 106 is controlled by the enable controller 114. Enablement of the bias network 108 may be directly controlled by the master enable signal according to this embodiment. Operation of the enable controller embodiment of FIG. 8 is described next with reference to the timing diagram illustrated in FIG. 9. The enable controller 114 includes a startup timer 138 for generating the startup circuit enable signal ($EN_{SU}$).

The startup timer 138 initially outputs a logic high signal level. The master enable signal actuates the startup timer 138 when the master enable signal is activated. The startup circuit output transitions to a logic zero signal level after the startup period lapses, which corresponds to time t2 in FIG. 9. The output of an AND logic gate 140, which depends on the state of the master enable signal and the startup timer output, determines the activation state of the startup circuit enable signal. Accordingly, the startup circuit enable signal remains active until time t2. At that point, the startup circuit enable signal is deactivated, causing the startup circuit 106 to disconnect from the bias network 108 and reset. The internal delay of the startup timer 138 may be selected to ensure that the startup circuit 106 is enabled long enough for sufficiently assisting the bias network 108 in re-enabling the amplifier 110, but is disabled before the voltage regulator 100 is deactivated at time t3.

Figure 10:
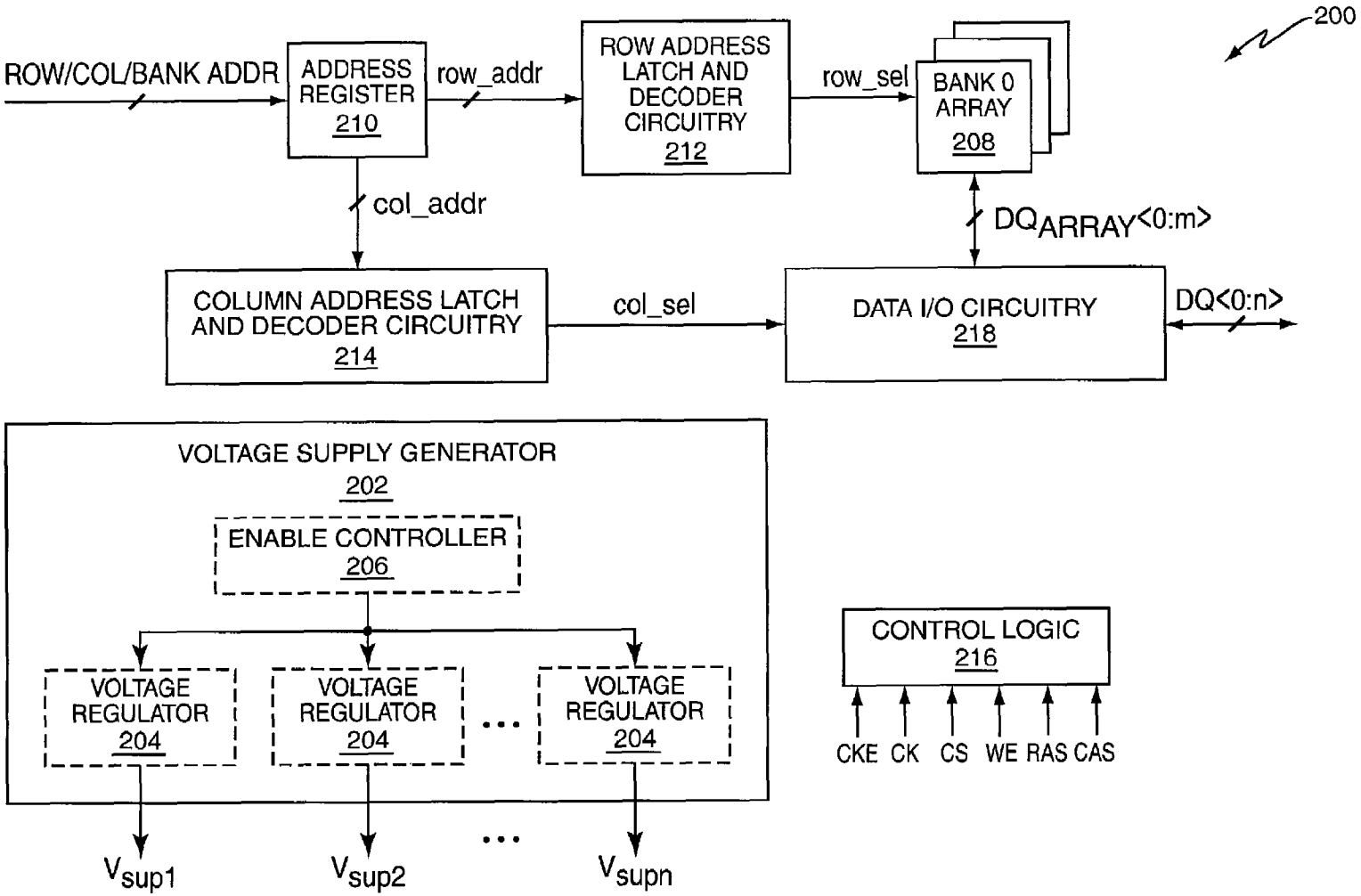
FIG. 10 is a block diagram of an embodiment of a memory device including one or more voltage regulators and corresponding enable circuitry.

The voltage regulator enablement embodiments disclosed herein may be employed in any type of integrated circuit requiring voltage regulation. FIG. 10 illustrates an embodiment of a memory device integrated circuit 200 including a voltage supply generator 202. The supply generator 202 includes one or more voltage regulators 204 for generating supply voltages ($V_{SUP1}$, $V_{SUP2}$, $V_{SUPn}$) for use by various components of the memory device 200. The voltage regulators 204 include an amplifier, bias network and startup circuit (each not shown). An enable controller 206 included in or associated with the supply generator 202 controls enablement of the voltage regulators 204. In one embodiment, operation of both the voltage regulator bias networks and the startup circuits is controlled by the enable controller 206 as previously described herein. In another embodiment, the enable controller 206 controls operation of either the voltage regulator bias networks or the startup circuits, but not both also as previously described herein.

Regardless, the memory device 200 includes a memory array 208 arranged as one or more banks of memory cells such as Dynamic RAM (DRAM), Ferroelectric RAM (FRAM), Magnetoresistive RAM (MRAM), Phase-change RAM (PRAM) or similar types of cells. Row, column and bank address information (ROW/COL/BANK ADDR) is provided to the memory device 200 and stored in an address register 210. The address information indicates which row and column location in the memory array 208 is to be accessed during a read or write operation (and bank if the memory array is so arranged). Row address latch and decoder circuitry 212 determines which row in the memory array 208 is selected (row_sel) during a memory operation based on row address information retrieved from the address register 210. Likewise, column address latch and decoder circuitry 214 determines which columns in the memory array 208 are selected (col_sel).

Control logic 216 included in the memory device 200 manages overall memory device operation responsive to a clock enable signal (CKE), clock signal (CK), chip select signal (CS), write enable signal (WE), row address strobe signal (RAS), column address strobe signal (CAS) and the address signals, as is well known in the art. The memory device 200 also includes data I/O circuitry 218 coupled to the memory array 208 via a memory array bus $DQ_{ARRAY}$<0:m>. The data I/O circuitry 218 controls the flow of data into and out of the memory array 208. The data I/O circuitry 218 also couples the memory array bus to a main data bus DQ<0:n>. The data I/O circuitry 218 may include masking logic, gating logic, write drivers, sense amplifiers, latches, and the like for managing data flow.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A method of operating a voltage regulator circuit, comprising:

enabling a bias network operable to set a bias current in an amplifier;

connecting a startup circuit to the bias network, the startup circuit operable to assist the bias network in setting the amplifier bias current during a startup period; and disconnecting the startup circuit from the bias network responsive to the startup period lapsing while the voltage regulator circuit is enabled for resetting the startup circuit to an initial state.

2. The method of claim 1, wherein disconnecting the startup circuit from the bias network comprises:

disconnecting one or more boost capacitors from the bias network; and shorting the one or more boost capacitors to a supply voltage.

3. The method of claim 1, wherein disconnecting the startup circuit from the bias network comprises disconnecting the startup circuit from the bias network responsive to a timer indicating lapse of the startup period.

4. The method of claim 3, further comprising starting the timer responsive to activation of an enable signal.

5. The method of claim 1, further comprising:

disabling the bias network to reduce the amplifier bias current; and preventing subsequent re-enablement of the bias network until the amplifier is reliably disabled.

6. The method of claim 5, wherein preventing subsequent re-enablement of the bias network until the amplifier is reliably disabled comprises preventing subsequent re-enablement of the bias network until one or more bias voltages output by the bias network attain a voltage level sufficient to reliably disable the amplifier.

7. The method of claim 5, wherein preventing subsequent re-enablement of the bias network until the amplifier is reliably disabled comprises preventing subsequent re-enablement of the bias network until a timer indicates that the amplifier has been reliably disabled.

8. A voltage regulator circuit, comprising:

an amplifier configured to output a regulated voltage when enabled;

a bias network configured to enable the amplifier by setting a bias current in the amplifier when the bias network is enabled and to reduce the amplifier bias current when the bias network is disabled; and a startup circuit configured to assist the bias network in setting the amplifier bias current when connected to the bias network during a startup period and to reset to an initial state when disconnected from the bias network responsive to the startup period lapsing while the voltage regulator circuit is enabled.

9. The voltage regulator circuit of claim 8, wherein the startup circuit comprises one or more boost capacitors disconnected from the bias network after the startup period lapses and shorted to a supply voltage.

10. The voltage regulator circuit of claim 8, further comprising a timer configured to indicate when the startup period lapses.

11. The voltage regulator circuit of claim 10, wherein the timer is configured to start responsive to activation of an enable signal.

12. The voltage regulator circuit of claim 8, further comprising circuitry configured to disable the bias network and to prevent subsequent re-enablement of the bias network until the amplifier is reliably disabled.

13. The voltage regulator circuit of claim 12, wherein the circuitry is configured to prevent subsequent re-enablement of the bias network until one or more bias voltages output by the bias network attain a voltage level sufficient to reliably disable the amplifier.

14. The voltage regulator circuit of claim 12, wherein the circuitry comprises a timer configured to indicate when the amplifier is reliably disabled.

15. A memory device including the voltage regulator circuit of claim 8.

* * * * *